US012434286B2

(12) United States Patent
Morsut et al.

(10) Patent No.: US 12,434,286 B2
(45) Date of Patent: Oct. 7, 2025

(54) DRAWING BENCH FOR DRAWING MACHINE

(71) Applicant: DANIELI & C. OFFICINE MECCANICHE S.p.A., Buttrio (IT)

(72) Inventors: Riccardo Morsut, Terzo di Aquileia (IT); Majcol Schiavo, Virco (IT)

(73) Assignee: DANIELI & C. OFFICINE MECCANICHE S.P.A., Buttrio (IT)

( * ) Notice: Subject to any disclaimer, the term of this patent is extended or adjusted under 35 U.S.C. 154(b) by 71 days.

(21) Appl. No.: 18/040,086

(22) PCT Filed: Aug. 5, 2020

(86) PCT No.: PCT/IB2020/057393
§ 371 (c)(1),
(2) Date: Jan. 31, 2023

(87) PCT Pub. No.: WO2022/029469
PCT Pub. Date: Feb. 10, 2022

(65) Prior Publication Data

US 2023/0271239 A1 Aug. 31, 2023

(51) Int. Cl.
*B21C 1/30* (2006.01)
*B21C 1/28* (2006.01)

(52) U.S. Cl.
CPC . *B21C 1/30* (2013.01); *B21C 1/28* (2013.01)

(58) Field of Classification Search
CPC .... B21C 1/16; B21C 1/26; B21C 1/27; B21C 1/28; B21C 1/30
See application file for complete search history.

(56) References Cited

U.S. PATENT DOCUMENTS

| | | | | |
|---|---|---|---|---|
| 2,243,382 | A | 5/1941 | Korbuly | |
| 2,674,367 | A | 4/1954 | White et al. | |
| 3,659,531 | A * | 5/1972 | Goeke | B21C 1/30 414/17 |

FOREIGN PATENT DOCUMENTS

| | | | |
|---|---|---|---|
| CN | 105032961 | A | 11/2015 |
| CN | 106881363 | A | 6/2017 |
| DE | 2451105 | A1 | 4/1976 |
| DE | 2739812 | A1 | 3/1979 |
| DE | 2905790 | A1 | 8/1980 |
| GB | 1458170 | A | 12/1976 |
| SU | 489562 | A2 | 10/1975 |
| SU | 510286 | A1 | 4/1976 |
| SU | 916007 | A1 | 3/1982 |

(Continued)

OTHER PUBLICATIONS

DE2905790A (Year: 1980).*

(Continued)

*Primary Examiner* — Teresa M Ekiert
(74) *Attorney, Agent, or Firm* — Stetina Garred Brucker & Newboles

(57) ABSTRACT

A drawing bench of a drawing machine comprising a drawing carriage which is translatable along a predetermined direction on a base structure; a rack-pinion system adapted to translate the drawing carriage along said predetermined direction on the base structure;

wherein the rack-pinion system comprises at least two motors; at least two pinions and one or more racks;

and wherein each motor is adapted to drive a respective pinion.

13 Claims, 3 Drawing Sheets

(56) References Cited

FOREIGN PATENT DOCUMENTS

SU 1088195 A1 9/1985

OTHER PUBLICATIONS

Patent Cooperation Treaty, International Search Report for International Application No. PCT/IB2020/057393, mailed Apr. 29, 2021, 11 pages.
Chinese Office Action for Application No. CN202080104477.8A; mailed Nov. 11, 2024.

* cited by examiner

DRAWING BENCH FOR DRAWING MACHINE

CROSS-REFERENCE TO RELATED APPLICATIONS

This application claims priority to PCT International Application No. PCT/IB2020/057393 filed on Aug. 5, 2020, the entire disclosure of which is expressly incorporated herein by reference.

STATEMENT RE: FEDERALLY SPONSORED RESEARCH/DEVELOPMENT

Not Applicable

BACKGROUND

Field of the Invention

The present invention relates to the field of manufacturing metal products by means of drawing. More specifically, the invention relates to a drawing bench and a related drawing machine destined, in particular, to draw massive metal products.

Background Art

As known, drawing is a forming process not involving material removal, by means of which a size reduction and/or a shape change is induced in the cross-section of a product or semi-finished product by forcing it to pass through a fixed orifice, referred to as a die, suitably sized and shaped so as to give the finished, drawn product, predetermined size and cross-sectional profile. The forced passage through the die is obtained by exerting a traction on the workpiece at the outlet side of the die.

Drawing, in particular cold drawing, is currently widely used for manufacturing various metal products of an elongated shape, such as for example wires, profiled bars, pipes, etc.

In particular, for drawing massive metal products in the form of bars or pipes, drawing machines are known comprising a die, a guide bench placed on the inlet side of the die, i.e., upstream thereof with respect to the drawing direction, and a drawing bench placed on the outlet side of the die, i.e. downstream thereof with respect to the drawing direction. The guide bench is a usually a passive component and essentially serves to support and guide the piece upstream of the die. The drawing bench, instead, is an active part of the drawing machine and comprises a base structure and a drawing carriage capable of translating on the base structure in the drawing direction. The drawing carriage is destined to receive and clamp one end of the workpiece downstream of the die and to apply the traction force required for drawing to the piece itself.

Conventionally, in these known drawing machines, the movement of the drawing carriage and therefore the traction force for the drawing are obtained by means of chain drive systems installed in the base structure of the drawing bench. Such systems comprise a chain extending in the drawing direction and circulating about at least two toothed pulleys, at least one of which being motorized, which are integral with the base structure. The drawing carriage is equipped with a hook connected as a pin to the frame thereof and adapted to engage with one of the pins of the chain, by means of which it is possible to kinematically couple/uncouple the drawing carriage and the chain.

The Applicant has found that the use of chain drive systems in the drawing benches of the known drawing machines described above involves some drawbacks.

The components of the drive system, in particular the chain, the driving toothed pulley and the motor unit driving the latter, are sized according to the maximum traction force to be delivered, which, in the case of drawing massive metal products, may also be very high, for example, in the order of a hundred tons. This has a negative impact on the volume, weight, cost, and commercial availability of the drive system components.

Furthermore, chain drive systems are subjected to the so-called "pendulum" phenomenon, consisting of periodic oscillations of the tangential speed of a chain dragged by a toothed pulley, caused by corresponding variations in the tangential force acting on the chain pins which occur due to the periodic passage of the pins in the curved section of chain wrapped about the toothed pulley. Such tangential speed oscillations of the chain are transmitted to the drawing carriage and therefore have an impact on the traction force generated by the latter. If the amplitude thereof exceeds a certain threshold, surface defects (rings) appear on the drawn product which lead to commercial downgrading.

Another drawback related to the use of chain drive systems is due to the not negligible power losses in the transmission from the driving toothed pulley to the drawing carriage, attributable both to the interaction dynamics between the chain and the toothed pulleys themselves, and to the length of the kinematic chain between the aforesaid components. Such losses may even overall reach 15-20% of the motion power supplied at input, and therefore have a significant impact on the operating costs of the drawing machine.

A further drawback related to the use of chain drive systems is the noise thereof. In this respect, in the case of the known drawing machines described above, it is necessary to take into account not only a stationary noise component, due to the circulation of the chain during the operation of the machine, but also an impulsive noise component, which is generated every time the hook of the drawing bench releases the chain at the end of a drawing stroke and the upper branch of the chain collapses by gravity on supports specially provided in the base structure of the drawing bench. In particular, this periodic impulsive component may reach or exceed the limit of 120 dB (pain threshold), so in known drawing machines it is also necessary to adopt specific acoustic insulation measures to comply with the relevant regulations in force, which have an impact on the manufacturing costs of known drawing machines.

Furthermore, in the known drawing machines described above, a possible sudden breakage of the chain, given the high forces and masses involved, is a danger for the safety of the operators, requiring appropriate safety measures to avoid it, which also contribute to increase the costs of such drawing machines.

Finding an adequate alternative to chain drive systems is not trivial.

Indeed, an issue common to all known drawing benches concerns the size and cost of the motor which is used to move the drawing carriage. Indeed, the motor is particularly bulky and expensive, in particular because the motor must be selected according to the maximum traction force to be delivered.

SUMMARY OF THE INVENTION

It is an object of the present invention to provide a drawing bench and a related drawing machine which overcome the drawbacks mentioned above with reference to the known drawing machines for drawing massive metal products.

More particularly, it is an object of the invention to provide a drawing bench and a related drawing machine which, as compared to the known drawing benches and drawing machines of equal potential, offer greater versatility and operating efficiency, are less bulky, have lower production and operating costs, are less noisy, and are capable of always supplying high-quality drawn products.

It is a particular object of the present invention to reduce the overall volumes and costs of the movement means, in particular of the motor means, adapted to move the drawing carriage.

The present invention achieves at least one of such objects and other objects which will become apparent in light of the present description, by a drawing bench of a drawing machine, comprising:

- a drawing carriage which is translatable along a predetermined direction on a base structure;
- a rack-pinion system adapted to translate the drawing carriage along said predetermined direction on the base structure;
  - wherein the rack-pinion system comprises
  - at least two motors,
  - at least two pinions,
  - and one or more racks;
  - and wherein each motor is adapted to drive a respective pinion.

Advantageously, the rack-pinion system is a mechanical transmission with rigid elements, i.e., a mechanical transmission in which, preferably, all the components which take part in the power transfer have a rigid, i.e., non-flexible, structure.

Advantageously, the drawing bench according to the invention offers an easily scalable solution for the drive system of the drawing carriage, to the full advantage of the configuration and operational versatility of the drawing bench of the invention. Indeed, power generation and transfer can be distributed among more than one motor. Therefore, both the motors and the other components of the mechanical transmission, in particular of the rack-pinion system, can be individually sized for lower loads than a maximum load corresponding to the maximum traction force which the drawing bench must deliver. This has a positive effect on the manufacturing and operating costs of the drawing bench of the invention. On the one hand, indeed, smaller sized components usually available on the market can be used for the drive system of the drawing carriage, on the other hand, the drawing bench can easily deliver traction forces lower than the maximum possible force without significant decreases in efficiency.

As compared to a chain transmission, a mechanical transmission with rigid elements also allows reducing the number of components and obtaining a higher overall transmission efficiency. This advantageously allows reducing the installed power with equal performance, and therefore contributes to the reduction of manufacturing and operating costs.

Furthermore, by virtue of the fact that in mechanical transmissions with rigid elements there are intrinsically no "pendulum" phenomena, typical instead of chain transmissions, with the drawing bench of the invention it is advantageously possible to always ensure a constant translation speed of the drawing carriage, by virtue of which it is possible to obtain drawn products without defects caused by the oscillations of the traction force applied by the drawing carriage.

Furthermore, with a mechanical transmission with rigid elements the noise issues affecting the drawing machines of the known art due to the use of chain transmissions are substantially eliminated. In particular, the impulsive noise components related to the impact of the chain on the supports thereof, when it is released at the end of a drawing stroke, are completely absent. Therefore, special soundproofing measures are not required in the drawing benches of the invention to comply with the noise thresholds imposed by the regulations in force, with a further advantage for the manufacturing costs of the drawing machines.

Furthermore, in the drawing bench of the invention there are also substantially no safety issues related to a possible sudden breakage of the components under load of the drive system of the drawing carriage, which affect the known drawing machines.

The invention also relates to a drawing machine.

Further features and advantages of the invention will become more apparent in light of the detailed description of exemplary but not exclusive embodiments.

The dependent claims describe particular embodiments of the invention, the content of which is fully incorporated herein for reference.

BRIEF DESCRIPTION OF THE DRAWINGS

In the description of the invention, reference is made to the accompanying drawings, which are provided by way of non-limiting example, in which.

The same elements, or functionally equivalent elements, have the same reference numeral.

DESCRIPTION OF EXEMPLARY EMBODIMENTS OF THE INVENTION

Figure 1:
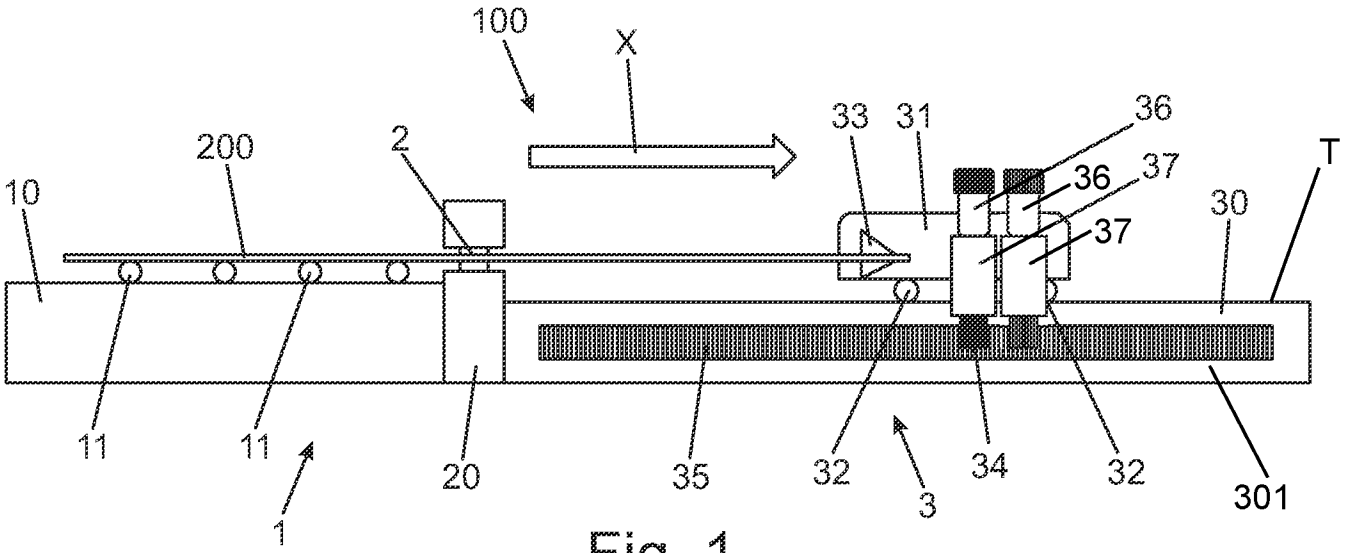
FIG. 1 diagrammatically shows a drawing machine according to the present invention.

With reference to the Figures, exemplary embodiments of a drawing bench 3 and of a drawing machine 100 according to the invention are described.

In all embodiments, the drawing bench 3 comprises:

- a drawing carriage 31 which is translatable, i.e., adapted to translate, along a predetermined direction X on a base structure 30;
- a rack-pinion system adapted to translate the drawing carriage 31 along said predetermined direction X on the base structure 30;
  - wherein the rack-pinion system comprises
  - at least two motors 36 (or, in other words, a plurality of motors 36),
  - at least two pinions 34 (or, in other words, a plurality of pinions 34),
  - and one or more racks 35;
  - and wherein each motor 36 is adapted to drive a respective pinion 34, preferably only the respective pinion 34.

Advantageously, since at least two motors 36 are provided, each connected to the respective pinion 34, the drawing force exerted on said one or more racks 35 can be distributed between the at least two pinion 34-motor 36 pairs. For example, when two motors 36, or three motors 36, are provided, the drawing force can be respectively distributed among the two or the three motors 36.

Therefore, as compared to a drawing bench provided with a single motor and a single pinion, the motors 36 and preferably also the pinions 34 may have a smaller size, and also have a significantly lower cost.

Furthermore, advantageously, a drawing bench 31 according to the invention allows greater versatility of use. Indeed, depending on the needs, only some of said at least two motors 36 can be activated. In other words, preferably, the motors 36 may be activated independently of each other.

The motors 36 are, in particular, distinct from each other.

The drawing bench 3 is, in particular, the drawing bench of a drawing machine 100 or, in other words, it is a drawing bench for a drawing machine.

FIG. 1 diagrammatically shows a drawing machine in accordance with the invention, overall indicated with reference numeral 100.

The drawing machine 100 is preferably, although not exclusively, used for drawing massive metal products or semi-finished products in the form of bars or pipes.

The drawing machine 100 comprises, in sequence, along the drawing direction X, a guide bench 1, a die 2 and a drawing bench 3.

The aforesaid drawing direction X, or drawing axis, is, in particular, straight.

The guide bench 1 is configured so as to define a support base 10, in particular a continuous or discontinuous support base, for guiding, preferably passively, a workpiece 200 towards the die 2 in the drawing direction X. To facilitate the movement of the workpiece 200, means can preferably be provided on the support base 10 to support and guide the translation of the workpiece towards the die 2. Said means may, for example, comprise or consist of idle sliding rollers 11 or other equivalent means.

The die 2 is mounted, preferably in a removable manner (i.e., so that it can be disassembled), in a corresponding support 20, preferably integral with the guide bench 1 and/or with the drawing bench 3. The shape and size of the die 2 determine the profile and the size of the cross-section of the drawn product.

As already mentioned, the drawing bench 3 comprises a base structure 30, or support base, and a drawing carriage 31.

The base structure 30 extends, in particular, in the drawing direction X.

The base structure 30 has, in particular, a fixed position.

Preferably, the base structure 30 has a substantially beam-like shape.

The drawing carriage 31 is capable of translating longitudinally, i.e., along the drawing direction X, on the base structure 30 itself.

In particular, the base structure 30 defines a plane T, on which the drawing carriage 31 can translate. The plane T is also referred to as the translation plane T of the drawing carriage 31. The translation plane T is preferably defined by an upper surface of the base structure 30.

Preferably, rolling or sliding support and/or guiding means are provided, such as for example wheels 32, by means of which the drawing carriage 31 and the base structure 30 can cooperate with each other. Exclusively by way of example, said rolling or sliding support and/or guiding means are fastened to the drawing carriage 31.

Figure 2:
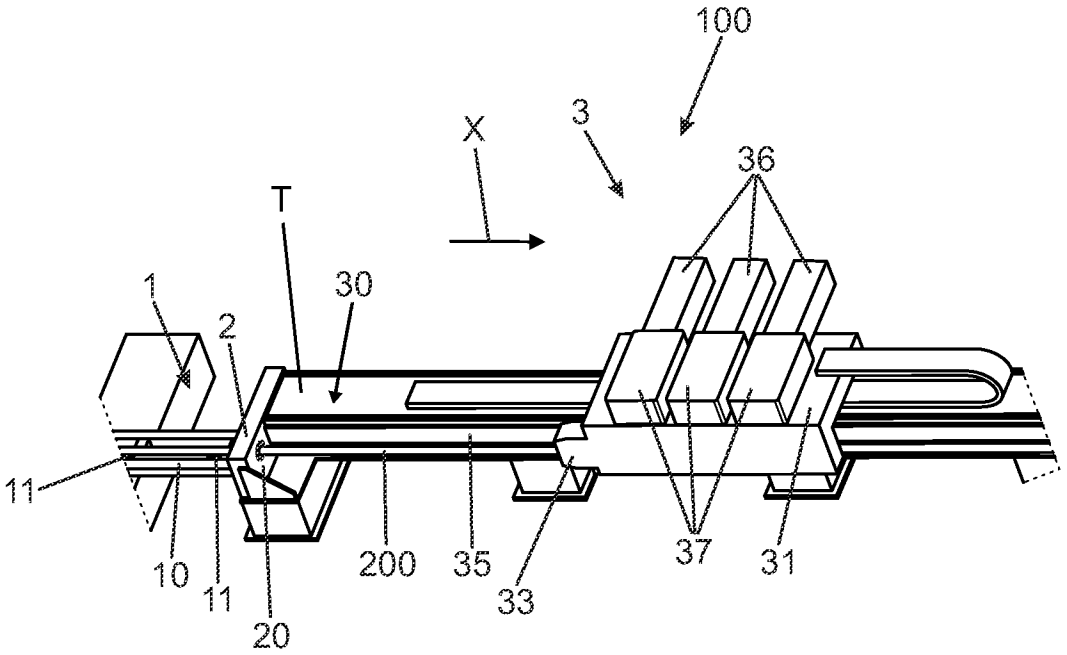
FIG. 2 shows a perspective view of part of a drawing machine according to the present invention.
Figure 3:
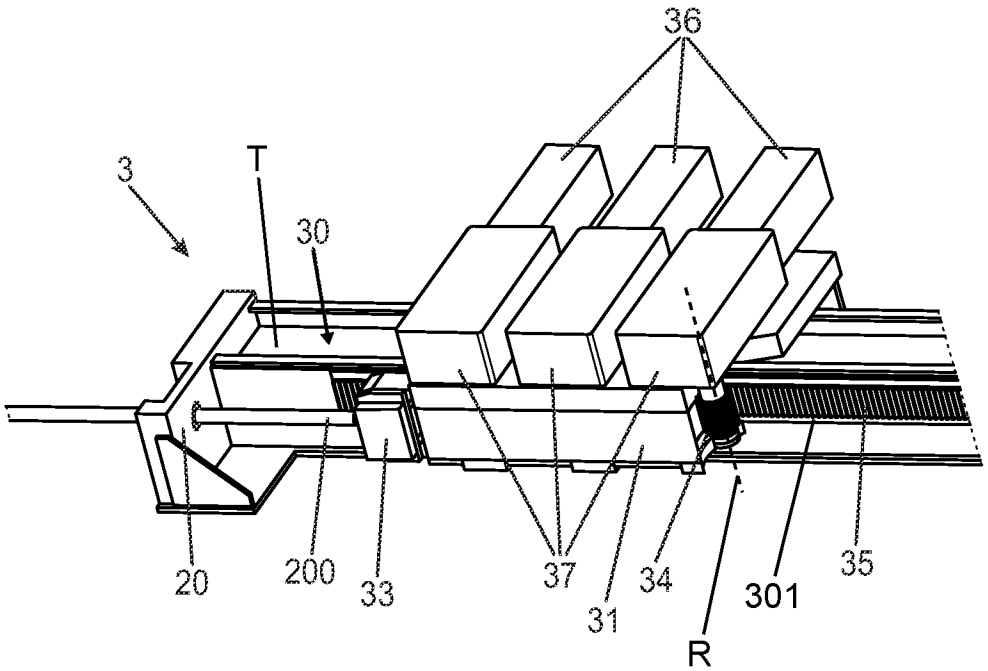
FIG. 3 shows a perspective view of part of the drawing bench of the drawing machine of FIG. 2.

The drawing carriage 31 can cooperate with the base structure 30 at only one side of the base structure 30 (FIG. 1), or, preferably, it can be configured so as to embrace, i.e., surround, the base structure 30 on at least two, more preferably three or at least three, sides thereof (FIGS. 2, 3).

The drawing carriage 31 comprises a clamping device 33 adapted to receive and clamp one end of the workpiece 200 from the downstream side of the die 2. When the workpiece 200 is clamped by the clamping device 33, the drawing carriage 31, translating away from the die 2 along the drawing direction X, is capable of applying to the workpiece 200 the traction force required to pass it through the die 2, thus causing the drawing thereof. The length of the base structure 30 and the length of the translation stroke of the drawing carriage 31 are designed according to the length of the workpieces 200, i.e., of the products to be drawn with the drawing machine 100.

The drawing bench 3 also comprises a drive system, or movement system, of the drawing carriage 31. In particular, the drive system comprises or consists of a rack-pinion system.

More in detail, as already mentioned, the drawing bench 3 comprises a rack-pinion system adapted to translate the drawing carriage 31 along said predetermined direction X on the base structure 30. In other words, in order to translate the drawing carriage 31, said rack-pinion system is provided, i.e., a rack-and-pinion transmission.

In the example shown in FIG. 1, two motors 36 and two pinions 34 are provided. One of the two motors 36 is adapted to drive one of the two pinions 34, and the other of the two motors 36 is adapted to drive the other of the two pinions 34.

In the example shown in FIGS. 2 and 3, three motors 36 and three pinions 34 are provided.

Preferably, but not exclusively, the pinions 34 are engaged with the same rack 35 of said one or more racks. In particular, only one rack 35 is preferably provided, as in the examples shown.

Each rack 35 of said one or more racks extends longitudinally parallel to the drawing direction X.

Preferably, each motor 36 is of the electric type. Preferably, each motor 36 comprises a respective shaft (not shown), in particular a respective motor shaft, adapted to rotate and to transmit the rotation motion to the respective pinion 34.

Preferably, each motor 36, in particular the shaft of each motor 36, is connected to the respective pinion 34 by means of a gear reducer 37.

Each motor 36 and the respective gear reducer 37 preferably form or are part of a respective gearmotor assembly.

For a better distribution of the loads, the motors 36, in particular the gearmotor assemblies, substantially rest on the drawing carriage 31. In particular, the motors 36 preferably have a position such that the rotation axes of the respective shafts are substantially parallel to the translation plane T of the drawing carriage 31, and therefore perpendicular to the rotation axes R of the pinions 34. Preferably, the gear reducers 37 interposed between each motor 36 and the respective pinion 34 are angular.

Preferably, but not exclusively, each pinion 34 is integral, in particular integral in translation, with the drawing carriage 31 and said one or more racks 35 are integral with the base structure 30. In particular, each pinion 34 can rotate about the respective rotation axis R thereof (FIG. 3), and the rotation of the pinions 34 causes the translation of the drawing carriage 31 and also of the pinions 34 together with the drawing carriage 31.

Preferably, the motors 36 are advantageously mounted on board the drawing carriage 31, i.e., they can translate together with the drawing carriage 31, thus reducing the volume of the drawing machine 100 on the ground.

Preferably, said at least two pinions 34 and said one or more racks 35 cooperate with each other on at least one plane, for example one plane, parallel to the drawing direction X and preferably substantially perpendicular to the translation plane T of the drawing carriage 31 on the base structure 30.

In particular, as in the examples shown, the rack 35 is preferably arranged on a longitudinal, preferably external, side 301 of the base structure 30. Said longitudinal side 301, in particular, extends perpendicularly to the translation plane T of the drawing carriage 31. The pinions 34 preferably extend in a cantilever manner from the drawing carriage 31 at the same longitudinal side 301 of the base structure 30, with a respective rotation axis R perpendicular to the translation plane T of the drawing carriage 31.

The aforesaid longitudinal side 301, or side wall 301, is in particular a wall which extends substantially perpendicularly to the translation plane T.

The arrangement of the one or more racks 35 on one or more side walls, for example, of the base structure 30, allows reducing the overall volume as compared to a solution in which the one or more racks are arranged on an upper surface of the base structure 30, the latter however being a possible variant.

The one or more racks 35 may also be mounted on an internal longitudinal side, i.e., on an internal surface of a side wall, of the base structure 30.

Exclusively by way of example and not by way of limitation, a drawing machine 100 may be adapted to deliver high traction forces, for example, at least 100 tons, for example, equal to about 100 tons.

Advantageously, in all embodiments, each pinion 34-motor 36 pair (in particular, each pinion 34 and the related gearmotor assembly) can be configured to withstand only a fraction of the maximum load corresponding to the maximum traction force which can be generated in the drawing machine 100.

For example, when three motors 36 and three pinions 34 are provided, each pinion 34-motor 36 pair may be configured to withstand one third of said maximum load.

Optionally, operating modes may be provided in which only some (for example, one or more) of the pinions 34 are active, while the others (one or more) remain idle and do not transfer power, so that the drawing machine 100 may deliver in a flexible manner and always with high efficiency even traction forces below the maximum traction force.

Optionally, in all embodiments, two or more racks 35 may be provided.

For example, a rack may be provided for each pinion 34, and each pinion 34 is engaged with a respective rack 35.

Or, for example, when four motors 36 and four pinions 34 are provided, two pinions 34 may be engaged with a rack 35 and the other two pinions 34 may be engaged with another rack 35.

When at least two racks 35 are provided, for example two racks 35, preferably, a first rack and a second rack of said at least two racks are fastened to the same side wall 301 of the base structure 30; or a first rack is fastened to a first side wall 301 of the base structure 30, and a second rack is fastened to a second side wall of the base structure 30, opposite to said first side wall 301.

Exclusively by way of example, each rack 35 may be fastened to the external surface or to the internal surface of the respective side wall of the base structure 30.

The pinions 34 and the related motors 36 may be appropriately distributed among the racks 35, preferably so as to ensure a force transmission symmetrical with respect to the drawing direction X.

In light of the present description, those skilled in the art are able to understand that said one or more racks 35 may be integral with the drawing carriage 31 and said at least two pinions 34 may be integral with the base structure 30.

In this case, preferably, said one or more racks 35 are preferably fastened to a side wall of the drawing carriage 31.

For example, when at least two racks 35 are provided, for example two racks 35, a first rack and a second rack of said at least two racks may be fastened to the same side wall of the drawing carriage 31; or a first rack is fastened to a first side wall of the drawing carriage, and a second rack is fastened to a second side wall of the drawing carriage 31, opposite to said first side wall.

Although reference has been made in particular to a single-line drawing machine 100, the invention may also be implemented in multi-line drawing machines, adapted to simultaneously draw multiple workpieces 200 in parallel.

In all cases, the drawing force can be advantageously distributed among more than one motor 36, so as to reduce the size and generally the cost of each motor, in particular as compared to when only one motor is provided.

Advantageously, moreover, flexible transmission elements, in particular chains, for driving the drawing carriage are preferably absent. This allows for a more versatile and efficient operation, a reduction in manufacturing and operating costs and in noise levels, and the obtainment of high-quality drawn products.

Advantageously, the rack-pinion system for driving, in particular for moving, the drawing carriage 31 is a particularly simple, compact, robust and easy-to-maintain technical solution for moving the drawing carriage 31 and generating the traction force required for the drawing, preferably using only rigid transmission elements. Furthermore, as already explained, this solution is easily scalable, as the traction force can be increased by increasing the number of active pinions on the rack (or on the racks).

It is clear that the number of motors 36 and of the related pinions 34 may be selected according to the needs, and may be at least equal to two, for example two, at least equal to three, for example three, at least equal to four, for example four, and it may even be more than four.

Preferably, but not exclusively, the motors 36 are equal or substantially equal to one another; and/or the pinions 34 are equal or substantially equal to one another.

The invention claimed is:

1. A drawing bench of a drawing machine, comprising:

a drawing carriage which is translatable along a predetermined direction on a base structure, a rack-pinion system adapted to translate the drawing carriage along said predetermined direction on the base structure;

wherein the rack-pinion system comprises at least two motors, at least two pinions, and one or more racks;

wherein each motor is adapted to drive a respective pinion;

wherein the drawing carriage embraces the base structure on at least two sides;

and wherein the rotation axis of each pinion is substantially orthogonal to a translation plane of the drawing carriage on the base structure.

2. The drawing bench according to claim 1, wherein said at least two pinions are engaged with the same rack of said one or more racks.

3. The drawing bench according to claim 1, wherein each pinion is engaged with a respective rack.

4. The drawing bench according to claim 1, wherein said at least two pinions are integral with the drawing carriage and said one or more racks are integral with said base structure; or wherein said at least two pinions are integral with said base structure and said one or more racks are integral with the drawing carriage.

5. The drawing bench according to claim 1, wherein said one or more racks are fastened to a side wall of the base structure; or wherein said one or more racks are fastened to a side wall of the drawing carriage.

6. The drawing bench according to claim 1, wherein the rack-pinion system comprises at least two racks, wherein a first rack and a second rack of said at least two racks are fastened to the same side wall of the base structure or of the drawing carriage, or wherein a first rack is fastened to a first side wall of the base structure or of the drawing carriage, and a second rack is fastened to a second side wall of the base structure or of the drawing carriage, opposite to said first side wall.

7. The drawing bench according to claim 1, wherein said at least two pinions and said one or more racks cooperate with one another on at least one plane substantially perpendicular to the translation plane of the drawing carriage on the base structure.

8. The drawing bench according to claim 1, wherein the rack-pinion system comprises at least three motors and at least three pinions.

9. The drawing bench according to claim 1, wherein each motor of said at least two motors is connected to the respective pinion by means of a gear reducer and/or wherein each motor of said at least two motors is an electric motor.

10. The drawing bench according to claim 1, wherein each motor of said at least two motors comprises a respective shaft having a rotation axis perpendicular to the rotation axis of the respective pinion.

11. The drawing bench according to claim 1, wherein said at least two motors are mounted on board the drawing carriage.

12. A drawing machine comprising a drawing bench according to claim 1.

13. The drawing machine according to claim 12, comprising, in sequence along the drawing direction, a guide bench, a die and said drawing bench.

* * * * *